United States Patent [19]

Miller

[11] 4,070,295

[45] Jan. 24, 1978

[54] SULFONE COPOLYMERIC ADDITIVE FOR HYDROCARBON OILS

[75] Inventor: Harold N. Miller, Millington, N.J.

[73] Assignee: Exxon Research and Engineering Company, Linden, N.J.

[21] Appl. No.: 654,204

[22] Filed: Feb. 2, 1976

[51] Int. Cl.[2] ..... C10M 1/38

[52] U.S. Cl. ..... 252/48.6; 252/47.5; 252/48.2

[58] Field of Search ..... 252/47.5, 48.2, 48.6

[56] References Cited

U.S. PATENT DOCUMENTS

| | | | |
|---|---|---|---|
| 2,652,368 | 9/1953 | Melstrom et al. | 252/48.2 |
| 3,173,870 | 3/1965 | Fields | 252/48.2 X |
| 3,442,790 | 5/1969 | Burkard et al. | 252/48.2 |

*Primary Examiner*—George Crasanakis
*Assistant Examiner*—Andrew M. Metz
*Attorney, Agent, or Firm*—Roland A. Dexter; Frank T. Johmann

[57] ABSTRACT

Sulfone copolymeric oil additives having utility as a lubricating oil pour point depressant, viscosity index improver, dispersant, load carrying agent, rust inhibitor and/or antioxidant, or as a cold flow improver for heavy distillates and residual fuels, comprise the hydrocarbon soluble copolymers of an ethylenically unsaturated polar monomer and sulfur dioxide. This sulfone copolymer may contain one or more additional monomers including: $C_2$ to $C_{50}$, preferably at least $C_6$, substantially linear alpha olefins; $C_2$ to $C_{12}$, preferably $C_2$ to $C_9$, cyclic olefins; and, $C_4$ to $C_6$ conjugated diolefins.

8 Claims, No Drawings

SULFONE COPOLYMERIC ADDITIVE FOR HYDROCARBON OILS

BACKGROUND OF THE INVENTION

1. Field of the Invention

This invention relates to additives for hydrocarbons having utility to impart to lubricating oils when incorporated therein, one or more of the properties of improved viscosity index, lowered pour point, sludge dispersancy, increased load carrying ability, increased rust inhibition and increased resistance to oxidation; and, to residual fuels and heavy distillates an improvement in cold flow properties. More particularly, this invention relates to such additives for hydrocarbons which comprise the copolymers of an ethylenically unsaturated polar monomer and sulfur dioxide, which copolymers may contain one or more additional monomers including substantially linear alpha olefins, cyclic olefins and conjugated diolefins.

2. Prior Art

The products resulting from the polymerization of sulfur dioxide with unsaturated compounds such as unsaturated alcohols, ethers, esters and acids (see U.S. Pat. No. 2,114,292); and, with olefins and ethylenically unsaturated polar compounds (see U.S. Pat. Nos. 2,241,900, 2,645,631, 3,563,961 and 3,684,778) are well known in the art. The copolymers of sulfur dioxide and unsaturated compounds are prepared by various processes, including bulk, solution and emulsion polymerization.

In U.S. Pat. Nos. 3,409,548, 3,396,115 and British Pat. No. 1,258,758 copolymers of olefins and sulfur dioxide are taught as useful in oil-based fracturing fluids, dry cleaning solvents and coking, respectively.

U.S. Pat. No. 2,652,368 describes the use of alkylene sulfone copolymers of $SO_2$ and olefins in lubricating oil compositions to enhance viscosity temperature performance in torque converters. These copolymers were obtained by the polymerization of alpha-olefinic hydrocarbons having from 7 to 24 carbon atoms and $SO_2$ at the latter's reflux temperature and in the presence of catalyst such as peroxides and nitrates.

U.S. Pat. No. 3,442,790 shows $C_{12}$–$C_{52}$ olefins and sulfur dioxide copolymers as wax crystal modifiers. These materials are added to wax-containing petroleum oil materials, for example, so as to modify the size and shape of wax crystals in such a manner as to permit more rapid separation of the wax during the dewaxing of the hydrocarbon oil.

SUMMARY OF THE INVENTION

In distinction to the products and processes of the prior art, most of which are primarily directed to the production of sulfone polymers comprising the reaction products of sulfur dioxide and olefins/diolefins, it has been found that hydrocarbon soluble sulfone copolymers of an ethylenically unsaturated polar monomer can be usefully incorporated into lubricating oils for enhanced oxidation resistance and/or anti-wear property. When said ethylenically unsaturated polar monomer has average pendant hydrocarbyl groups of from about 6 carbons to about 50 carbons, preferably 8 to 30 carbons, the sulfone copolymer can be added to usefully modify the pour point and/or dispersancy and/or viscosity index and/or anti-rust property and/or anti-wear property and/or antioxidation property of lubricating oils and enhance the cold flow properties of residual fuels and heavy distillates. A preferred class of these sulfone copolymers contain a substantial amount i.e. up to about 60 mole % of a third monomer which is not an ethylenically unsaturated polar monomer, e.g. a substantially linear alpha olefin of from about 2 to 50, preferably about 10 to 20 carbon atoms, as a partial replacement of said polar monomer. These sulfone polymers are readily prepared using thermal or induced decomposition of free radical initiators. They may be prepared in batch, semi-batch, semi-continuous or continuous operations using solution or bulk polymerization methods. Their useful number average molecular weights ($\overline{M}n$) range from about 400 to about 750,000, preferably from about 500 to about 500,000 (as measured by Vapor Pressure Osmometry (VPO) from 400 to about 25,000 and by Membrane Osmometry above 25,000).

DETAILED DESCRIPTION OF THE INVENTION

1. Monomers

A. Sulfur Dioxide

Since sulfur dioxide is readily available, the useful sulfone copolymers of the invention are produced from the sulfur dioxide. The sulfone copolymer product obtained by the reaction of $SO_2$ and an ethylenically unsaturated polar monomer can be considered an alternating copolymer containing about equal molar amounts of the sulfur dioxide and the ethylenically unsaturated monomer.

It is to be understood, however, that in some instances the respective molar amounts of the polar monomer including the olefinic monomer content and the sulfur dioxide contained within the copolymer may not necessarily be the same. For example, in the presence of a suitable polymerization catalyst such as those hereinafter described, it would be expected that some homopolymerization of said polar monomer, or the olefin which is used to replace a part of said polar monomer, would take place thereby producing a copolymer containing more than 50 mole % of said polar momoner, and if present, the olefin monomer. The present invention, therefore, contemplates the use of a sulfone copolymer comprising from about 50 to about 70 mole % of said polar monomer plus olefin, and from about 30 to about 50 mole % of sulfur dioxide.

B. Ethylenically Unsaturated Polar Monomers

The polar monomers suitable for practice of this invention are monoethylenically unsaturated polar monomers which are copolymerizable with $SO_2$, have a total of 8 to 52, preferably 10 to 32 carbons and generally consist of carbon, hydrogen and one or more atoms selected from the group consisting of oxygen, nitrogen, halogen and sulfur.

In preferred sense these polar monomers may be represented by the general formula:

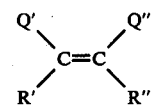

wherein R' and R'' are independently selected from the group consisting of hydrogen, halogen and a $C_1$ to $C_{12}$ alkyl radical such as methyl and Q' is selected from the group consisting of carboxy (—COOH); cyano (—CN); hydroxy methyl (—$CH_2$—OH); and carboalkoxy (—

COOR'''), wherein R''' is selected from the group consisting of $C_1$ to $C_{24}$ straight and branched-chain alkyl, arylalkyl, and cycloalkyl radicals; alkoxy methyl ($—CH_2—O—R'''$) and methyl hydrocarbyl ketone ($—CH_2—CO—R'''$) wherein R''' is as above; hydrocarbyl ketone ($—O—R'''$) wherein R''' is as above; and Q'' is selected from the group consisting of hydrogen; carboxy (—COOH); cyano (—CN); and carboalkoxy (—COOR''') wherein R''' has the meaning set forth above.

Particularly preferred are $C_1$ to $C_{22}$ acyclic or alicyclic esters of acrylic acid which are illustrated by the general formula $CH_2{=}CH—COOR^{IV}$ wherein $R^{IV}$ is selected from the group consisting of straight or branched-chain alkyl radicals, arylalkyl radicals, cycloalkyl-alkylene radicals, and perfluoroalkyl radicals. Non-limiting examples are: methyl; ethyl; n-propyl, n-butyl; isobutyl; n-amyl; n-hexyl; 2-ethyl-hexyl; n-octyl; isooctyl derived by the oxonation of mixed heptenes followed by hydrogenation; isodecyl; 3,5,5-trimethyl hexyl; n-dodecyl; tridecyl; tetradecyl; heptadecyl; octadecyl; eicosenyl; docosenyl; benzyl and cyclohexyl radicals.

Another preferred subclass of polar monomers for preparation of the sulfone copolymer is (a) a fumaric acid ester or amide, (b) a maleic acid derivative, or (c) a $C_1$–$C_{22}$ alkyl maleate ester. Specifically, the most suitable members of this subclass are fumarate esters, maleate esters, maleic anhydride and methyl maleic anhydride (known as citraconic anhydride).

Another preferred subclass of polar monomers are $C_9$ to $C_{18}$ halomethyl aromatic vinyl compounds which are illustrated by the general formula $CH_2{=}CH—R^{V}—CH_2—X$ wherein $R^{V}$ is an arylene radical having from 1 to 3 rings and X is a halogen independently selected from the group consisting of chlorine, bromine and iodine. Non-limiting examples include: 3-chloromethyl-1-styrene; 4-chloromethyl styrene; 1-vinyl-4-chloromethyl naphthalene; 4-bromomethyl styrene; 5-chloromethyl-4-methyl styrene; 3-methoxy-4-chloromethyl styrene.

C. Olefinic Monomers

Olefinic monomers which are suitable for the practice of this invention to provide the sulfone copolymers include substantially linear $C_2$ to $C_{50}$ monoolefins having a Type I structure $R—CH{=}CH_2$; Type II structure $R—CH{=}CHR_a$ and the more difficulty copolymerizable Type III structure $R_a(R_b)C{=}CH_2$ wherein R, $R_a$ and $R_b$ are independently selected from the group consisting of hydrogen; straight and branched-chain alkyl; aryl; alkylaryl; arylalkyl and cycloalkyl. These type I, II, and III olefinic monomers can contain up to about 30 mol percent dienes.

Non-limiting examples of Type I olefins include ethylene, propylene; 1-butene; 1-pentene; 1-hexene; 4-methyl-1-pentene; 4,4-dimethyl-1-pentene; 1-dodecene; 1-octadecene; styrene; 4-methyl styrene; 3-phenyl-1propene; vinyl cyclohexane; 2-vinyl norbornene; and vinyl naphthalene. Type II examples include 2-butene; 2-pentene; 3-hexene; 4-octene; 5-octene; norbornene; cyclohexene; and cyclopentene.

Non-limiting examples of suitable Type III olefins include; isobutylene; 2,3-dimethyl-1-butene; 2,4,4-trimethyl-1-pentene; 2,6-dimethyl-1-octene, 4-isopropenyl toluene; isopropenyl cyclohexane; and α-methyl styrene.

The dienes include straight and branched chain acyclic and alicyclic, conjugated and non-conjugated dienes.

Non-limiting examples of conjugated diolefins, preferably $C_4$ to $C_{10}$ acyclic conjugated diolefins, which may be interpolymerized with the polar and olefinic monomers include: butadiene, isoprene; cis and trans piperylene; 2,3-dimethyl-1,3-butadiene; 1,3-hexadiene; 3,7-dimethyl-1,3-octadiene and 3-(4-methylpentyl)-1,3-butadiene.

Representative non-limiting examples of nonconjugated diolefins include:

A. Straight chain acyclic dienes such as: 1,4-hexadiene; 1,5-heptadiene, 1,6-octadiene.

B. Branched chain acyclic dienes such as: 5-methyl-1,4-hexadiene; 3,7-dimethyl 1,6-octadiene; 3,7-dimethyl 1,7-octadiene; and the mixed isomers of dihydromyrcene and dihydroocimene.

C. Single ring alicyclic dienes such as: 1,4-cyclohexadiene; 1,5-cyclo-octadiene; 1,5-cyclododecadiene; 3-allylcyclopentene; 4-allyl-cyclohexene and 1-isopropenyl 4(4-butenyl) cyclohexane.

D. Multi-single ring alicyclic dienes such as: 4,4'-dicyclopentenyl and 4,4'-dicyclohexenyl dienes.

E. Multi-ring alicyclic fused and bridged ring dienes such as: tetrahydroindene; methyl tetrahydroindene; dicyclopentadiene; bicyclo(2,2,1) hepta 2,5-diene; alkenyl, alkylidene, cycloalkenyl and cycloalkylidene norbornenes such as: 5-methylene-2-norbornene; 5-ethylidene-2-norbornene; 5-methylene-6-methyl-2-norbornene; 5-methylene-6,6-dimethyl-2-norbornene; 5-propenyl-2-norbornene; 5-(3-cyclopentenyl)-2-norbornene and 5-cyclohexylidene-2-norbornene.

The sulfone copolymers can usefully contain a total of from about 5% to about 68, preferably from about 10 to about 40 mole % of olefin monomer units; however, the diolefin monomer units thereeof will range up to a total of about 6 mole % of the copolymer.

2. Preparation of Sulfone Copolymers

In general, the polysulfone copolymers are prepared by dissolving the monomers, i.e. the polar monomer and if desired the olefinic monomer in a solvent, thereafter saturating the resulting solution with sulfur dioxide gas and while maintaining $SO_2$ flow through the reaction system, adding a catalyst. Preferably, the catalyst is added as a solution to the reaction system in periodic aliquot portions. The temperature of the polymerization medium is controlled and kept below the ceiling temperature for the monomers, i.e. the temperature above which the monomers will not polymerize. If desired, the monomers in part or whole can be added with the catalyst solution or shortly after its introduction into the polymerization system.

The inert solvent used for the reaction can be of four general types, i.e. hydrocarbons, halogenated hydrocarbons, glycol ethers and alkyl esters. Examples of the: first group are benzene, n-hexane, naphtha, kerosene, etc.; second group are perchloroethylene, methylene chloride, trichlorobenzene, carbon tetrachloride, etc.; third group are diethylene glycol, dimethyl ether, diethylene glycol ether, ethylene glycol dimethyl ether, etc; and, fourth group are ethyl acetate, ethyl butyrate, propyl acetate, etc.

The polymerization catalyst which can be used in this process is preferably of the free radical type. Examples of the free radical catalysts are, in general, any of the conventional free radical catalysts, for example, those of the peroxide or azo-types. By way of example, suitable peroxide-type catalysts include benzoyl peroxide, ditertiary butyl peroxide, diacetyl peroxide, diethyl peroxycarbonate and the preferred hydroperoxides as t-butyl hydroperoxide and 2-phenyl propane-2-hydroperoxide (cumene hydroperoxide). The azo-type catalysts are characterized by the presence in the molecule of the group —N=N bonded to one or two organic radicals, preferably at least one of the bonds being to a tertiary carbon atom. Suitable azo type catalysts are exemplified by α, α azodiisobutyronitrile, p-bromobenzene-diazonium fluoroborate, N-nitroso-p-bromoacetanilide, azo-methane, phenyldiazonium halides, diazoaminobenzene, p-bromobenzenediazonium hydroxide and p-tolyldiazoaminobenzene. The polymerization catalyst is used in small amounts, which are generally not in excess of two percent by weight based upon the monomeric material. A suitable quantity is often in the range of 0.05 to 0.5 percent by weight.

As the temperature of the reaction should not exceed the ceiling temperature of the polar monomers or olefins, it practically ranges from about −50° to about 100° C. with a preferred range of from about −30° to 30° C. The polymerization pressure can range from about 1 to 30 atmospheres.

Reaction time may vary widely, depending upon the reactivity of the particular monomers, catalyst concentrations and temperature of the reaction. Accordingly, polymerization times may vary from as little as 1 minute to 15 hours; with the preferred ranging from 5 minutes to 3 hours.

The preferred polymerization technique of the invention involves dissolving the monomer or monomers in the inert solvent prior to introduction of the radical forming catalyst. Usual levels of concentration of the monomers in the solvent ranges from about 10 to 60 wt. %.

The sulfone copolymer which is dissolved in the solvent at the end of the polymerization reaction can be readily separated therefrom by distillation of the solvent from the product copolymer. Another approach would be to precipitate the copolymer by admixing the solvent which contains the sulfone copolymer with a miscible non-solvent, for example, methanol. After precipitation from the solvent, the sulfone copolymer can be readily separated and dried.

The hydrocarbon or oil-soluble sulfone copolymeric reaction products of this invention can be usefully incorporated into liquid hydrocarbon compositions, e.g. automotive or diesel crankcase lubricating oil in order to provide one or more additive properties such an anti-wear, extreme pressure lubricity, viscosity index improvement, oxidation resistance, corrosion inhibition, etc. These copolymers, which can be tailored to provide these additive properties, are usefully dissolved in an amount sufficient to provide such a property or properties and preferably in concentrations in the range of about 0.01 to 20 wt. %. For example, they can be added in a viscosity improving amount, preferably about 1 to 20 wt.% for V.I. improvement; a dispersancy improving amount, preferably about 0.01–10 wt. % for dispersancy; an anti-rust improving amount, preferably about 0.05–5 wt. % as an anti-rust agent; an anti-oxidant improving amount, preferably about 0.01–2 wt. % as an anti-oxidant; a pour point depressing amount, preferably about 0.005–2 wt. % as a pour point depressant and, an extreme pressure lubricating amount, preferably about 0.05 to 10 wt. % for extreme pressure lubricity (enhanced load carrying ability). The products of this invention are useful additives, not only for hydrocarbon lubricants derived from petroleum, but for synthetic lubricants such as alkyl esters of dibasic acids; complex esters made by the esterification of dibasic acids, polyglycols, monobasic acids and alcohols: esters of carbonic and phosphoric acids; carboxylic esters of polyglycols; etc.

The residual fuel oils which are treated with the sulfone copolymer additives of this invention to improve their cold flow properties are wax-containing petroleum oils boiling point above about 340° C.

The residual or heavy distillate oils modified according to the invention will generally require the incorporation of a cold flow improving amount from about 0.001 to 2.0 wt. %, preferably 0.005 to 0.1 wt. %, of said sulfone copolymeric additive into either of said oils whereby its cold flow is improved. Preferably the $\overline{Mn}$ (number average molecular weight) of said sulfone copolymeric additives range from about 800 to about 500,000.

The sulfone copolymers of the present invention can be utilized in conventional solvent dewaxing processes. Preferably, said copolymers have a $\overline{Mn}$ ranging from 500 to 500,000. Typically, admixtures of the sulfone copolymer, dewaxing solvent and wax-containing oil are processed by chilling said admixture in any suitable manner to a wax precipitation temperature. The resultant precipitated wax may then be removed by conventional means, e.g. centrifugation or filtration (preferably the latter). Dewaxing operations are usually conducted at a temperature within the range of about −35° to about −5° C. and preferably at from about −25° to about −15° C. The amount of materials admixed will vary widely depending upon the particular dewaxing solvent used, as well as the type of petroleum oil being dewaxed. In general, solvent dewaxing feeds comprising a dewaxing amount, preferably from about 0.005 to about 4.0 wt % of sulfone copolymer, from about 50 to about 90 wt. % of the dewaxing solvent and from about 10 to about 50 wt. % of the wax-containing petroleum oil can be easily and efficiently filtered in conventional dewaxing filtration equipment. Nonlimiting examples of suitable dewaxing solvents include benzene, toluene, acetone, methylethyl ketone, propane, hexane, ethylene dichloride, aliphatic alcohols, naphtha, the like and mixtures thereof. All wt. % as used in this specification are based on the total weight of the composition or admixture unless otherwise stated.

In general, the sulfone copolymers are useful, according to this invention, with pendant hydrocarbyl groups of from about 6 to 50 carbons. It is possible to tailor these sulfone copolymers, as earlier noted, so as to enhance their additive utility by adjusting the average carbon content of the hydrocarbyl groups, and/or the carbon/sulfur ratio, of said copolymers for greatest additive activity in the particular lubricant and/or hydrocarbon system into which the sulfone copolymer is admixed. When the sulfone copolymer is added for extreme pressure lubricity (load carrying property) for lubricants such as a lubricating oil, the pendant hydrocarbyl group preferably averages from about 8 to 30 carbons, optimally 10 to 18. For dispersant, antioxidant, rust inhibition and viscosity indexing improving applications, the pendant hydrocarbyl groups preferably average from about 6 to 18 carbons, optimally 8 to 16; and, for cold flow improvement of residual oils, the pendant hydrocarbyl groups preferably average about 10 to 26 carbons, optimally 17 to 24 carbons.

The invention can be more fully understood by reference to the following examples which are offered by way of illustration and not by way of limitation. Examples 1 to 4 and 6 to 8, all containing a polar monomer, represent the invention. Example 5, without the polar monomer, represents prior art.

EXAMPLE 1

Sulfone Copolymer of $SO_2$ and allyl alcohol

Twenty-nine grams (0.5 moles) of allyl alcohol was dissolved in 100 milliliters of ethyl acetate contained in a 1-liter reaction flask. The solution was saturated with sulfur dioxide and maintained with a sulfur dioxide atmosphere during polymerization under a pressure slightly in excess of atmospheric. 0.5 grams of t-butyl hydroperoxide dissolved in 40 milliliters of ethyl acetate was periodically added in two 10 ml. and four 5 ml. aliquot portions to the reactive solution over a time period of about 2 hours. The reaction vessel was maintained in a water bath whereby the temperature of the reaction was maintained between about 5° to about 19° C. Approximately 31 grams (0.5 moles) of $SO_2$ was consumed in the reaction to produce a sulfone copolymer which precipitated from the solution. After the polymerization reaction was completed, the system was sparged with nitrogen and the polymer precipitated in normal hexane. The yield was 58.8 grams of polymer (approximately 96.4% yield) having a grayish white appearance.

EXAMPLE 2

Sulfone Copolymer of $SO_2$ and allyl acetate, tetradecene-1 and hexadecene-1

The general procedure of Example 1 was used, however, the amount of monomers, introduction and nature of catalyst solution, and temperature were changed as follows:

19.6 grams (0.1 moles) of tetradecene-1 (>90% purity), 22.4 grams (0.1 moles) of hexadecene-1 (>90% purity), and 2.1 grams (0.021 moles) of allyl acetate was dissolved in 92 mls. of benzene; 11.7 grams (0.18 moles) of $SO_2$ were consumed during polymerization; 0.9 grams of t-butyl hydroperoxide (dissolved in 80 mls. of benzene) was periodically introduced in three aliquot portions of 10 mls. and 2 aliquot portions of 20 mls. over the 85 minute period of the reaction; and, the temperature was maintained between 4° and 9° C. The sulfone copolymer was precipitated in methyl alcohol and reprecipitated in a mixture of toluene and methyl alcohol and finally vacuum dried. The yield was 48.3 grams (82.9% of theoretical). The sulfone copolymer had a $\overline{M}n$ of 7,918.

EXAMPLE 3

Sulfone copolymer of $SO_2$, allyl alcohol and hexene-1

The general procedure of Example 2 was followed with variations in the monomers and process noted hereafter: 42 grams (0.5 moles) hexene-1 (>90% purity) and 1.1 grams (0.02 moles) of allyl alcohol were dissolved in 50 ml. of benzene; 23.5 grams (0.37 moles) of $SO_2$ were consumed; 0.5 grams of t-butyl hydroperoxide was dissolved in 50 ml. of benzene; and, the reaction was carried on for 88 minutes and maintained at a temperature betweenn 5° and 10° C. with the catalyst solution being added in 10 ml aliquot portions at intervals of approximately 15–20 minutes. The resulting sulfone copolymer, precipitated in methyl alcohol, provided after drying 54 grams (70.7% of theoretical) of an off-white to light amber colored, amorphous product.

EXAMPLE 4

Sulfone copolymer of $SO_2$, allyl acetate and $C_{16}$–$C_{32}$ alpha olefins mixture The general procedure of Example 2 was followed with variations in the monomers and process noted hereafter: 23.4 grams (0.08 moles) of a mixture of $C_{16}$–$C_{32}$ alpha olefins (90.3 wt.% were $C_{18}$ to $C_{28}$ alpha olefins distributed as follows: $C_{18}$ — 8 wt.%; $C_{19}$ — 2.2 wt.%; $C_{20}$ — 17.4 wt.%; $C_{22}$ — 23.1 wt.%; $C_{24}$ — 19.9 wt.%; $C_{26}$ — 13.1 wt.%; $C_{28}$ — 6.6 wt.%) and 0.4 grams (0.004 moles) of allyl acetate dissolved in 125 mls of cyclohexane; an excess of 19 grams $SO_2$ was present during the polymerization; 0.5 grams of 5-butylhydroperoxide dissolved in 50 ml. of cyclohexane; and the polymerization conducted for 30 minutes during which 10 ml. aliquot portions of the solution of the free radical catalyst was added at approximately 5 minute intervals and the temperature maintained at about 10° C. A nitrogen sparge was carried out thereafter and the resulting polymer subsequently precipitated in methyl alcohol and vacuum desiccated. The polymer yield was 19.8 grams.

EXAMPLE 5 (for comparison)

Sulfone copolymer of $SO_2$, dodecene-1 and octadecene-1

The procedure of Example 2 was substantially followed but with variations in the monomers and process noted hereafter:

18 grams (0.106 moles) of dodecene-1 (~97% pure) and 36.2 grams (0.14 moles) of octadecene-1 (~97% pure) were dissolved in 54.2 grams of benzene; 45 grams (0.7 moles) of $SO_2$ was present during the polymerization; 0.5 grams of tertiary butyl hydroperoxide dissolved in 50 ml. of benzene was the catalyst solution; and the reaction was carried on for approximately 1 hour at 10°–21° C. The copolymer was precipitated in methyl alcohol and yielded 61.6 grams of sulfone copolymer having a $\overline{M}n$ of 10,673.

EXAMPLE 6

Sulfone copolymer of $SO_2$, allyl alcohol, dodecene-1 and octadecene-1

The procedure of Example 5 was followed but with variations in the monomers and temperature as follows:

17.1 grams (0.10 moles) of dodecene-1 (~99% pure), 34.3 grams (0.133 moles) of octadecene-1 (~99% pure) and 1.25 grams (0.022 moles) of allyl alcohol were dissolved in 50 ml. of benzene; 16.3 grams (0.26 moles) of $SO_2$ were consumed in the polymerization; and the temperature was maintained at from 6°–20° C. The yield was approximately 100% of said sulfone copolymer.

EXAMPLE 7

Sulfone copolymer of $SO_2$, allyl acetate, dodecene-1 and octadecene-1

The procedure of Example 6 was followed with a change in the monomers as follows:

18.0 grams (0.107 moles) of dodecene-1 (~99% pure), 36.2 grams (0.143 moles) of octadecene-1 (~99% pure) and 2.5 grams (0.025 moles) of allyl acetate were dissolved in 58 ml. of benzene; and 15.8 grams (0.25 moles) of $SO_2$ were consumed in the polymerization. The yield was 66.9 grams (90% of theoretical) of a copolymer having a $\overline{M}n$ of 10,329.

EXAMPLE 8

Sulfone Copolymer of $SO_2$ and the allyl esters of dodecanoic and octadecanoic acids The $C_{12}$ alphatic and $C_{18}$ aliphatic esters of allyl alcohol were prepared as follows: A 20 molar% excess of allyl alcohol was reacted in separate reactions with the respective aliphatic acid in cyclohexane. The esterifications were each catalyzed by paratoluene sulfonic acid. The temperature of each esterification was between 70° and 80° C. and was so maintained for a period of about 3 to 4 hours during which the water of esterification was distilled off by maintaining a reduced pressure over each reaction. Each resultant product solution was neutralized with sodium bicarbonate, water washed three times, after which 25 mls. of cyclohexane was added and the system left standing overnight in the presence of magnesium to produce the respective product esters. Thereafter, each system was rotovacuated to recover the respective allyl ester.

The copolymer were produced by the process of Example 3 with variations in the monomers and process as follows: 23.6 grams (0.10 moles) of dodecanoate ester of allyl alcohol and 22.2 grams (0.068 moles) of octadecanoate ester of allyl alcohol were dissolved in 50 ml. of benzene; 3.5 grams (0.06 moles) of $SO_2$ were consumed during polymerization; and polymerization was conducted for about 50 minutes. The yield was 18.6 grams (32.9% of theoretical) of a sulfone copolymer having a ($\overline{M}n$) of 1129.

The utility of the additives of the invention is demonstrated, in part, by data hereafter presented which information was derived from tests indicative of lubricating oil pour point depressant activity; residual fuel flow activity; and extreme pressure lubricity.

Illustrative and comparative lubricating oil pour depressant activity is shown in Table I.

TABLE I

| | Pour Point ° C., In Various Solvent Neutral Oils | | | |
|---|---|---|---|---|
| | SN 75 | SN 150 | SN 330 | SN 450 |
| Base Oil Neat | −18 | −15 | −9 | −9 |
| Example | 0.1 Wt. % Additive Added | | | |
| 5 | −34 | −34 | −26 | −26 |
| 7 | −29 | −32 | −29 | −32 |
| 8 | −23 | −23 | −26 | −26 |

Illustrative residual fuel flow activity is shown in Table II wherein the results of adding 0.15 wt.% os the additive to a residual fuel known as 343° C. FVT (final vapor temperature) Brega North African Residuum are set forth.

TABLE II

| | ° C. Flow Point of Residuum at Reheat Temperature | | | |
|---|---|---|---|---|
| | 38° C. | 46° C. | 54° C. | 66° C. |
| Residuum Neat | 41 | 41 | 41 | 41 |
| Residuum + copolymer of Example 4 | 21 | 21 | 21 | 13 |

The additive property of extreme pressure lubricity provided by the sulfone copolymers according to this invention is illustrated in the data of Table III. This data was obtained by testing lubricants modified by the addition of sulfone copolymers in a "Falex" lubricant testing machine sold by Fairlie-LeValley Corp. of Chicago, Illinois. This machine provides for rotation of a steel pin (lubricated by the test lubricant) in a chuck provided by 2 cooperating aluminum members pressing against a portion of said pin. The test is discontinued at the moment when the pin breaks. The test conditions were b 2 minutes at 250 rpm, followed by 500 rpm until breakage occurs. The test oil was mineral oil with the additive added in an amount of 0.5 wt.%, based on the weight of the oil.

TABLE III

| Additive of | Minutes to break at 500 rpm |
|---|---|
| Control (no additive) | 1.5 |
| Example 2 | 13 |
| Example 5 (comparison example) | 0.5 |
| Example 6 | 14 |

This data illustrates the enhanced extreme pressure lubricity of lubricating oils treated according to this invention relative to non-treated or treated with a copolymer of $SO_2$ and alpha olefins (Example 5).

In summary then, the useful sulfone copolymers according to this invention are obtained from the polymerization of from about 30 to about 50 mole percent of sulfur dioxide, from about 2 to about 70 mole percent of an ethylenically (preferably monoethylenically) unsaturated polar monomer having from 8 to 52 carbons and mixtures of said polar monomers, from 0 to about 68 mole percent of a $C_2$ to $C_{50}$ monoolefin and mixtures of said monoolefins and from 0 to about 6 mole percent of a diolefin and mixtures thereof, said copolymer having a $\overline{M}n$ of from 400 to 750,000.

The invention in its broader aspect is not limited to the specific details shown and described and departures may be made from such details without departing from the principles of the invention and without sacrificing its chief advantages.

What is claimed is:

1. A composition comprising a major proportion of lubricating oil, and dissolved therein, in the range of about 0.01 to 20 wt. %, based on the total weight of said composition, of oil soluble sulfone copolymer of:

a. about 30 to about 50 mole percent of sulfur dioxide, b. about 20 to about 70 mole percent of an ethylenically unsaturated polar monomer which is copolymerizable with sulfur dioxide and has a total of 8 to 52 carbon atoms and is represented by the general formula:

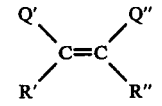

wherein R' and R'' are independently selected from the group consisting of hydrogen, halogen and $C_1$ to $C_{12}$ alkyl radicals; Q' is selected from the group consisting of —COOH, —CN, —$CH_2$OH, —COOR''', —$CH_2$—O—R'', —$CH_2$—CO—R''' and —O—R'''; and Q'' is selected from the group consisting of hydrogen, —COOH, —CN, and —COOR'''; and wherein R''' is selected from the group consisting of $C_1$ to $C_{24}$ straight and branched chain alkyl, arylalkyl, and cycloalkyl radicals;

c. 0 to about 68 mole % of $C_2$ to $C_{50}$ monoolefin; and d. 0 to about 6 mole % diolefin;

wherein said copolymer has a number average molecular weight ($\overline{M}n$) in the range of about 400 to about 750,000 and improves one or more properties of said lubricating oil.

2. A composition according to claim 1, wherein said lubricating oil is a hydrocarbon oil, wherein R', R'' and Q'' are each hydrogen, and Q' is selected from the group consisting of $—CH_2OH$ and $—CH_2OR'''$, wherein R''' is a $C_1$ to $C_{24}$ alkyl group, and said copolymer is formed by free radical polymerization at about —30° to about 30° C.

3. A composition according to claim 2, wherein Q' is $—CH_2OH$ whereby said formula defines allyl alcohol.

4. A composition according to claim 2, wherein Q' is $—CH_2OR'''$ whereby said formula defines an allyl ester.

5. A composition according to claim 1, wherein said copolymer has a $\overline{M}n$ of from about 500 to about 500,000 and said polar monomer has a total of from about 10 to about 32 carbons and average pendant hydrocarbyl groups of from about 8 to about 30 carbons.

6. A composition according to claim 1, wherein said copolymer contains from about 5 to about 68 mole percent of olefin monomer.

7. A composition according to claim 6, wherein said polar monomer is allyl alcohol and said olefin monomer is one or more $C_{12}$—$C_{18}$ alpha monoolefins.

8. A composition according to claim 6, wherein said polar monomer is an allyl ester of a carboxylic acid having from 1–18 carbon atoms and said olefin monomer is one or more $C_{12}$–$C_{32}$ alpha monoolefins.

* * * * *